US008181631B2

(12) United States Patent
Bohr et al.

(10) Patent No.: US 8,181,631 B2
(45) Date of Patent: May 22, 2012

(54) HYDROCARBON STORAGE CANISTER PURGE SYSTEM AND METHOD

(75) Inventors: Scott A. Bohr, Plymouth, MI (US); Chris Christopher Kragh, Commerce Township, MI (US); Mark W. Peters, Wolverine Lake, MI (US); Michael G Heim, Brownstown, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 14 days.

(21) Appl. No.: 12/479,779

(22) Filed: Jun. 6, 2009

(65) Prior Publication Data

US 2010/0307461 A1 Dec. 9, 2010

(51) Int. Cl.
*F02M 33/04* (2006.01)
*F02M 33/02* (2006.01)

(52) U.S. Cl. ..... 123/520; 180/65.1

(58) Field of Classification Search ..... 123/518, 123/519, 520, 521, 516; 137/587, 588, 589; 180/65.1; 903/902
See application file for complete search history.

(56) References Cited

U.S. PATENT DOCUMENTS

| | | | | |
|---|---|---|---|---|
| 4,025,324 | A | 5/1977 | Stackhouse et al. | |
| 5,707,430 | A | 1/1998 | Hara et al. | |
| 6,202,632 | B1 * | 3/2001 | Geiger et al. | 123/520 |
| 6,237,575 | B1 * | 5/2001 | Lampert et al. | 123/520 |
| 6,293,261 | B1 | 9/2001 | Oemcke et al. | |
| 6,499,476 | B1 * | 12/2002 | Reddy | 123/704 |
| 6,557,534 | B2 * | 5/2003 | Robichaux et al. | 123/520 |
| 6,659,087 | B1 * | 12/2003 | Reddy | 123/520 |
| 2009/0216426 | A1 * | 8/2009 | Wang et al. | 701/103 |

FOREIGN PATENT DOCUMENTS

| | | | |
|---|---|---|---|
| JP | 4353254 | A | 12/1992 |
| JP | 7189821 | A | 7/1995 |
| JP | 11257049 | A | 9/1999 |

OTHER PUBLICATIONS

"Advanced Canister Purge Algorithm With a Virtual [HC] Sensor," <http://www.not2fast.com/efi/2000-01.0557.pdf>.

"An Empirical Model for Estimating Evaporative Hydrocarbon Emissions from Canister-Equipped Vehicles," http://www.sciencedirect.com/science.

* cited by examiner

*Primary Examiner* — Mahmoud Gimie
(74) *Attorney, Agent, or Firm* — David Kelley, Esq.; Tung & Associates

(57) ABSTRACT

A hydrocarbon canister purge system includes a hydrocarbon storage canister, a fuel tank disposed in fluid communication with the hydrocarbon storage canister, an engine disposed in fluid communication with the hydrocarbon storage canister, a hydrocarbon sensor provided in the hydrocarbon storage canister and a controller disposed in signal-receiving communication with the hydrocarbon sensor and in signal-transmitting communication with the engine.

17 Claims, 2 Drawing Sheets

HYDROCARBON STORAGE CANISTER PURGE SYSTEM AND METHOD

FIELD OF THE INVENTION

The present disclosure relates generally to hydrocarbon storage canisters of hybrid electric vehicles (HEVs). More particularly, the present disclosure relates to a hydrocarbon storage canister purge system and method which senses the concentration of hydrocarbons in a hydrocarbon storage canister and purges the hydrocarbons from the hydrocarbon storage canister when necessary.

BACKGROUND OF THE INVENTION

Hydrocarbons may be difficult to purge from hydrocarbon storage canisters of HEVs during periods when the engine of the HEV is not being operated. Evaporative regulations may require that the hydrocarbon storage canister of HEVs be saturated with hydrocarbon prior to testing. Regulatory requirements may require purging of the hydrocarbon storage canister prior to diurnal testing.

Therefore, a hydrocarbon storage canister purge system and method are needed which are capable of determining the concentration of hydrocarbons in the canister outlet vent area of a hydrocarbon storage canister and purging the hydrocarbons from the hydrocarbon storage canister.

SUMMARY OF THE INVENTION

The present disclosure is generally directed to a hydrocarbon canister purge system. An illustrative embodiment of the hydrocarbon canister purge system includes a hydrocarbon storage canister, a fuel tank disposed in fluid communication with the hydrocarbon storage canister, an engine disposed in fluid communication with the hydrocarbon storage canister, a hydrocarbon sensor provided in the hydrocarbon storage canister and a controller disposed in signal-receiving communication with the hydrocarbon sensor and in signal-transmitting communication with the engine.

The present disclosure is further generally directed to a method of purging a hydrocarbon storage canister. An illustrative embodiment of the method includes providing a hydrocarbon storage canister, providing an engine in fluid communication with the hydrocarbon storage canister, providing a hydrocarbon threshold concentration value, determining a concentration of hydrocarbons in said hydrocarbon storage canister and purging the hydrocarbon storage canister by operating the engine when the concentration of hydrocarbons in the hydrocarbon storage canister exceeds the hydrocarbon threshold concentration value.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure which is defined by the claims. Furthermore, there is no intention to be bound by any expressed or implied theory presented in the preceding technical field, background, brief summary or the following detailed description.

Figure 1:
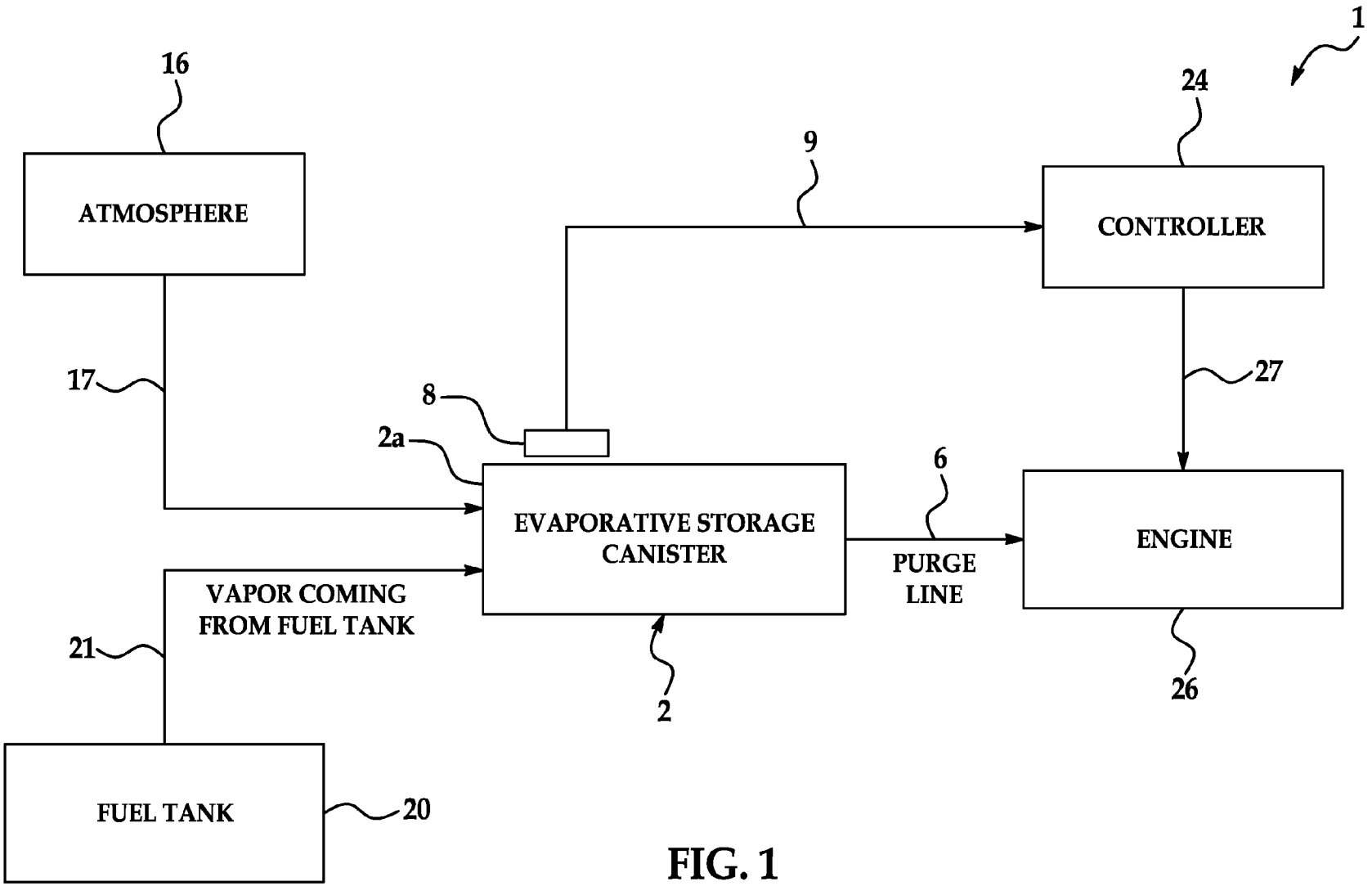
FIG. 1 is a functional block diagram of an illustrative embodiment of the hydrocarbon canister purge system.
Figure 2:
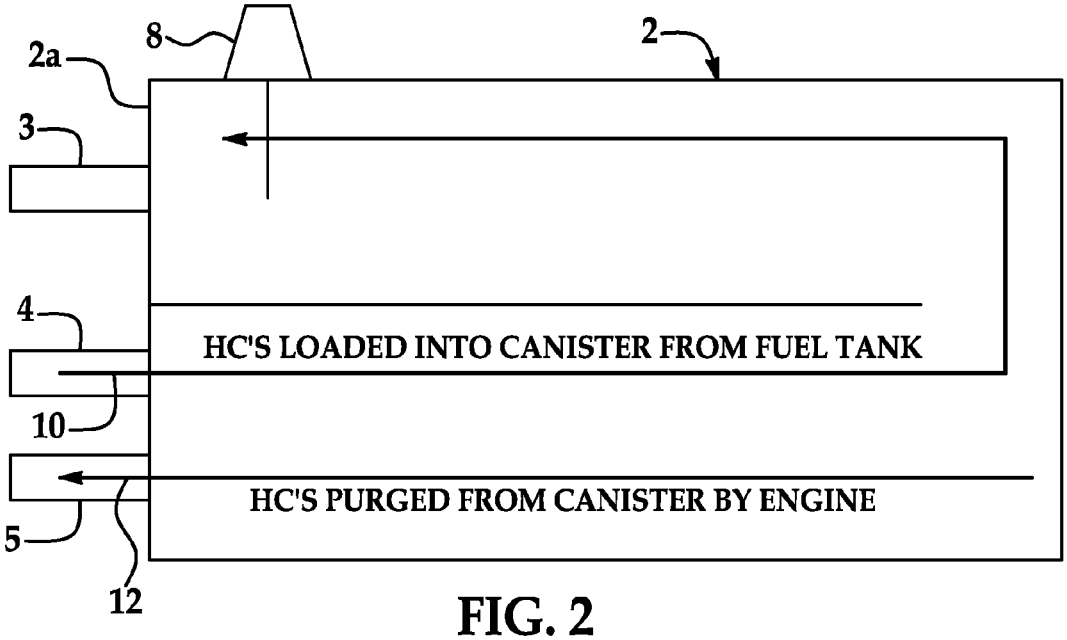
FIG. 2 is a block diagram of a hydrocarbon storage canister of an HEV, more particularly illustrating flow of fuel tank hydrocarbons from a fuel tank into the hydrocarbon storage canister and flow of purged hydrocarbons from the hydrocarbon storage canister.

Referring initially to FIGS. 1 and 2, an illustrative embodiment of the hydrocarbon canister purge system, hereinafter system, is generally indicated by reference numeral 1 in FIG. 1. The system 1 may be applicable to conventional powertrains (i.e. Otto, Miller, etc.) as well as HEV's (i.e. parallel, series, plug-in). The system 1 may include an evaporative hydrocarbon storage canister 2 of the HEV (not shown) which may contain a carbon bed (not shown). Atmospheric air 17 from the atmosphere 16 may be disposed in pneumatic communication with the hydrocarbon storage canister 2. A fuel tank 20 of the HEV may be disposed in fluid communication with the hydrocarbon storage canister 2 through a vapor inlet line 21. An engine 26 of the HEV may be disposed in fluid communication with the hydrocarbon storage canister 2 through a hydrocarbon purge line 6. The vapor inlet line 21 and the hydrocarbon purge line 6 may be connected to the hydrocarbon storage canister 2 through a fuel tank port 4 and a purge port 5 (FIG. 2), respectively. The atmospheric air 17 may be disposed in fluid communication with the hydrocarbon storage canister 2 through a fresh air port 3 (FIG. 2).

As further shown in FIGS. 1 and 2, the system 1 may further include a hydrocarbon sensor 8 which is disposed in contact with the hydrocarbon contents of the hydrocarbon storage canister 2. The hydrocarbon sensor 8 may be provided at a canister vent outlet area 2*a* of the hydrocarbon storage canister 2. In some embodiments, the hydrocarbon sensor 8 may be a linear output hydrocarbon sensor. As shown in FIG. 1, a controller 24 may be disposed in signal-receiving communication with the hydrocarbon sensor 8 through a sensor-controller connection 9. The controller 24 may be disposed in signal-transmitting communication with the engine 26 of the HEV through a controller-engine connection 27.

In typical operation of the system 1, the hydrocarbon storage canister 2 may be disposed in communication with atmospheric air 17 in the atmosphere 16 through the fresh air port 3 (FIG. 2). Fuel tank hydrocarbons 10 (FIG. 2) may be distributed from the fuel tank 20, through the vapor inlet line 21 and into the hydrocarbon storage canister 2, respectively. Eventually, the fuel tank hydrocarbons 10 from the fuel tank 20 may move across the carbon bed (not shown) in the hydrocarbon storage canister 2 and fill the hydrocarbon storage canister, including the canister outlet vent area 2*a* in which the hydrocarbon sensor 8 is located, as a result of diurnals and diffusion. Through the hydrocarbon sensor 8, the controller 24 may continually monitor the concentration of the fuel tank hydrocarbons 10 in the canister vent outlet area 2*a* of the hydrocarbon storage canister 2.

Under circumstances in which the concentration of fuel tank hydrocarbons 10 at the canister vent outlet area 2*a* is below a predetermined hydrocarbon threshold concentration value at which vapors of the fuel tank hydrocarbons 10 are about to exit the hydrocarbon storage canister 2 to the atmosphere 16, the controller 24 may not initiate operation of the engine 26. Under circumstances in which the concentration of the fuel tank hydrocarbons 10 meets or exceeds the predetermined hydrocarbon threshold concentration value, and therefore, vapors of the fuel tank hydrocarbons 10 are about to exit the hydrocarbon storage canister 2 to the atmosphere 16, the controller 24 may initiate operation of the engine 26 through the controller-engine connection 27. The controller 26 may also cause the engine 26 to purge excess hydrocarbons 12 (FIG. 2) from the hydrocarbon storage canister 2 through the purge line 6. When the concentration of fuel tank hydrocarbons 10 as measured by the hydrocarbon sensor 8 at the canister vent outlet area 2*a* again falls below the predetermined hydrocarbon threshold concentration value, the controller 24 may terminate purging of the hydrocarbons 12 from the hydrocarbon storage canister 2 by terminating operation of the engine 26. Therefore, the controller 24 may operate the engine 26 only under circumstances in which the concentration of the fuel tank hydrocarbons 10 exceeds the predetermined hydrocarbon threshold concentration value.

Figure 3:
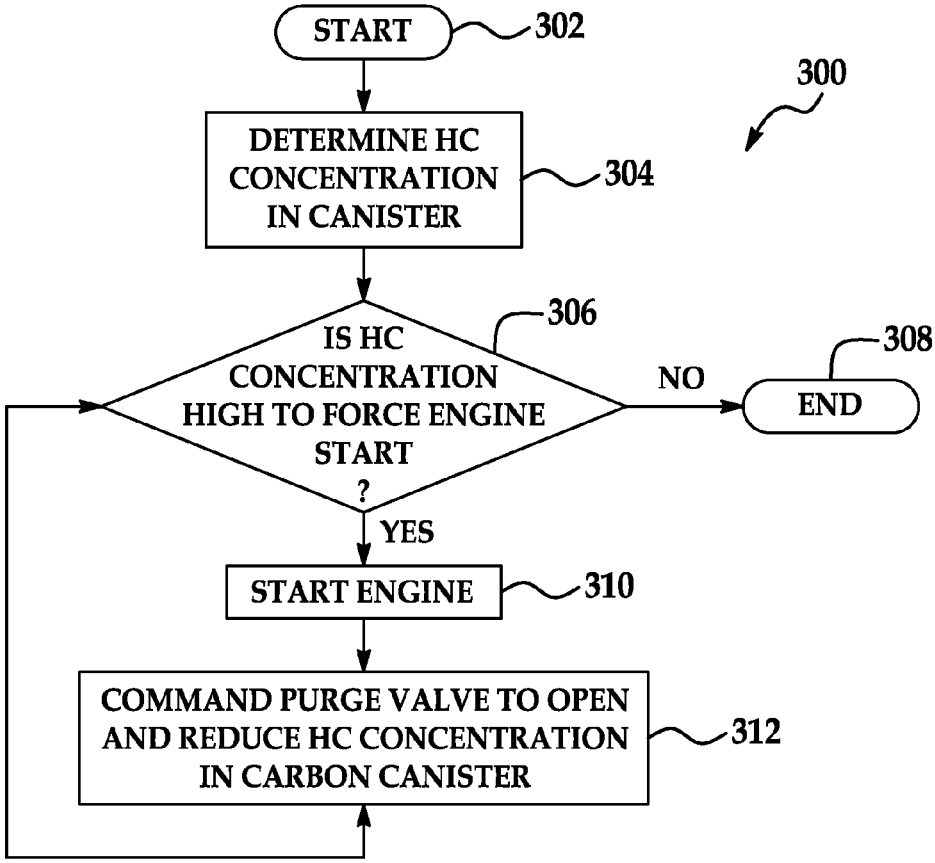
FIG. 3 is block diagram which illustrates an illustrative embodiment of a hydrocarbon storage canister purge method.

Referring next to FIG. 3, a flow diagram 300 which illustrates an illustrative embodiment of a hydrocarbon storage canister purge method is shown. The method begins at block 302. In block 304, the concentration of hydrocarbons in a hydrocarbon storage canister of an HEV is determined. In some embodiments, a hydrocarbon sensor may be provided in the hydrocarbon storage canister and the concentration of hydrocarbons in the hydrocarbon storage canister determined by operation of the hydrocarbon sensor. In some embodiments, atmospheric air may be provided in fluid communication with the hydrocarbon storage canister at a vent outlet area and the hydrocarbon sensor may be provided in the hydrocarbon storage canister at the vent outlet area. An engine of the HEV is disposed in fluid communication with the hydrocarbon storage canister.

In block 306, a determination is made as to whether the hydrocarbon concentration in the hydrocarbon storage canister exceeds a predetermined hydrocarbon concentration threshold value and therefore, is sufficiently high to force the engine of the HEV to start. If the hydrocarbon concentration in the hydrocarbon storage canister does not exceed the predetermined concentration threshold value and thus, is not sufficiently high to force starting of the HEV engine, the method may be terminated in block 308.

If the hydrocarbon concentration in the hydrocarbon storage canister exceeds the predetermined hydrocarbon concentration threshold value and thus, is sufficiently high to force starting of the HEV engine in block 306, the HEV engine is started in block 310. In block 312, a purge valve may then be opened to purge hydrocarbons from the hydrocarbon storage canister by operation of the engine to reduce the concentration of hydrocarbons in the hydrocarbon storage canister. The method may then return to block 306. In some embodiments, a controller may be provided in signal-receiving communication with the hydrocarbon sensor and in signal-transmitting communication with the engine. The hydrocarbon storage canister by be purged by operating the engine using the controller.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A hydrocarbon canister purge system, comprising:

a hydrocarbon storage canister having a fresh air port and a canister vent outlet area inside said hydrocarbon storage canister and generally adjacent to said fresh air port;

a fuel tank disposed in fluid communication with said hydrocarbon storage canister;

an engine disposed in fluid communication with said hydrocarbon storage canister;

a hydrocarbon sensor provided in said hydrocarbon storage canister at said canister vent outlet area; and a controller disposed in signal-receiving communication with said hydrocarbon sensor and in signal-transmitting communication with said engine, wherein said controller is adapted to start and operate the engine when the concentration of hydrocarbons in the hydrocarbon storage canister as sensed by said hydrocarbon sensor exceeds a hydrocarbon threshold concentration value and terminate operation of said engine when said concentration of hydrocarbons falls below said hydrocarbon threshold concentration value.

2. The system of claim 1 wherein said hydrocarbon sensor comprises a linear output hydrocarbon sensor.

3. The system of claim 1 further comprising atmospheric air disposed in fluid communication with said hydrocarbon storage canister.

4. The system of claim 1 further comprising a fuel tank port provided in fluid communication with said hydrocarbon storage canister and a vapor inlet line connecting said fuel tank and said fuel tank port.

5. The system of claim 1 further comprising a purge port provided in fluid communication with said hydrocarbon storage canister and a hydrocarbon purge line connecting said purge port and said engine.

6. A hydrocarbon canister purge system, comprising:

a hydrocarbon storage canister having a fresh air port and a canister vent outlet area inside said hydrogen storage canister and generally adjacent to said fresh air port;

a fuel tank disposed in fluid communication with said hydrocarbon storage canister;

an engine disposed in fluid communication with said hydrocarbon storage canister;

a hydrocarbon sensor provided in said hydrocarbon storage canister at said canister vent outlet area;

a controller disposed in signal-receiving communication with said hydrocarbon sensor and in signal-transmitting communication with said engine; and wherein said hydrocarbon sensor is adapted to monitor concentration of hydrocarbons in said hydrocarbon storage canister and said controller is adapted to start and operate said engine to purge hydrocarbons from said hydrocarbon storage canister when said concentration of hydrocarbons in said hydrocarbon storage canister exceeds a predetermined hydrocarbon threshold concentration value and terminate operation of said engine when said concentration of hydrocarbons falls below said hydrocarbon threshold concentration value.

7. The system of claim 6 wherein said hydrocarbon sensor comprises a linear output hydrocarbon sensor.

8. The system of claim 6 further comprising atmospheric air disposed in fluid communication with said hydrocarbon storage canister.

9. The system of claim 8 further comprises a canister vent outlet area provided in said hydrocarbon storage canister and wherein said atmospheric air is disposed in fluid communication with said vent outlet area.

10. The system of claim 9 wherein said hydrocarbon sensor is provided at said vent outlet area of said hydrocarbon storage canister and adapted to monitor concentration of said hydrocarbons at said vent outlet area.

11. The system of claim 8 further comprising a fresh air port provided in fluid communication with said hydrocarbon storage canister and wherein said atmospheric air is disposed in fluid communication with said fresh air port.

12. The system of claim 6 further comprising a fuel tank port provided in fluid communication with said hydrocarbon storage canister and a vapor inlet line connecting said fuel tank and said fuel tank port.

13. The system of claim 6 further comprising a purge port provided in fluid communication with said hydrocarbon storage canister and a hydrocarbon purge line connecting said purge port and said engine.

14. A method of purging a hydrocarbon storage canister, comprising:

providing a hydrocarbon storage canister having a fresh air ort and a canister vent outlet area inside said hydrogen storage canister and generally adjacent to said fresh air port;

providing an engine in fluid communication with said hydrocarbon storage canister;

providing a hydrocarbon threshold concentration value;

determining a concentration of hydrocarbons in said hydrocarbon storage canister at said canister vent outlet area; and purging said hydrocarbon storage canister by starting and operating said engine when said concentration of hydrocarbons in said hydrocarbon storage canister exceeds said hydrocarbon threshold concentration value, and terminating operation of said engine when said concentration of hydrocarbons falls below said hydrocarbon threshold concentration value.

15. The method of claim 14 wherein said determining a concentration of hydrocarbons in said hydrocarbon storage canister comprises providing a hydrocarbon sensor in said hydrocarbon storage canister and determining said concentration of hydrocarbons in said hydrocarbon storage canister by operation of said hydrocarbon sensor.

16. The method of claim 15 further comprising providing a controller in signal-receiving communication with said hydrocarbon sensor and in signal-transmitting communication with said engine and wherein said purging said hydrocarbon storage canister by starting and operating said engine comprises purging said hydrocarbon storage canister by starting and operating said engine using said controller.

17. The method of claim 14 further comprising providing atmospheric air in fluid communication with said hydrocarbon storage canister at a vent outlet area and wherein said providing a hydrocarbon sensor in said hydrocarbon storage canister comprises providing a hydrocarbon sensor in said hydrocarbon storage canister at said vent outlet area.

* * * * *